United States Patent [19]

Kleinschmidt et al.

[11] 3,980,032

[45] Sept. 14, 1976

[54] SEWING MACHINE HAVING AUTOMATIC FEED CONTROL SYSTEM

[75] Inventors: Johann Otto Kleinschmidt, Wettersbach; Wolfgang Niem, Leonberg, both of Germany

[73] Assignee: Union Special Maschinenfabrik G.m.b.H., Stuttgart, Germany

[22] Filed: Apr. 17, 1975

[21] Appl. No.: 569,030

[52] U.S. Cl. ..... 112/209; 112/121.11

[51] Int. Cl.[2] ..... D05B 27/08

[58] Field of Search ..... 112/209, 208, 203, 121.11, 112/121.12, 2; 226/32; 250/548

[56] References Cited

UNITED STATES PATENTS

| | | | |
|---|---|---|---|
| 2,934,753 | 4/1960 | Laman | 226/32 X |
| 3,013,513 | 12/1961 | Judelson | 112/203 |
| 3,867,889 | 2/1975 | Conner, Jr. | 112/121.11 |

*Primary Examiner*—Werner H. Schroeder
*Assistant Examiner*—Peter Nerbun
*Attorney, Agent, or Firm*—John A. Schaerli; John W. Harbst

[57] ABSTRACT

Fabric lengths are monitored during and/or prior to sewing by sensing means in conjunction with a logic system. Differences in fabric ply lengths are compensated for by the logic systems control via stepping motors of the differential feed assembly located above and below the fabric plies.

4 Claims, 5 Drawing Figures

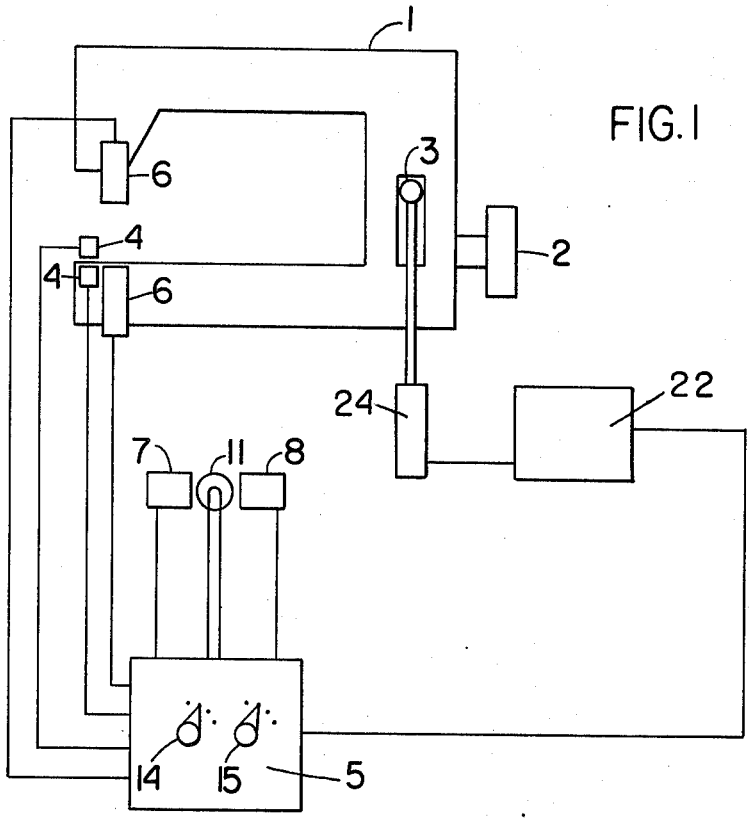
FIG. 1
FIG. 2
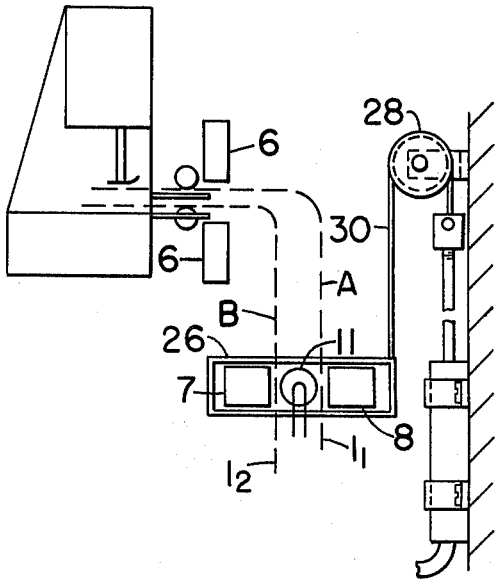

SEWING MACHINE HAVING AUTOMATIC FEED CONTROL SYSTEM

This invention relates to sewing machines and more particularly to a sewing machine having differential feed systems and to an automatic system for controlling the actuation thereof.

Sewing machines with differential feed systems are well-known as are automatic control means for such feed systems, as examples by German Pat. No. 2,161,295. There are disadvantages, however, with such prior art devices. For example, in the area of changeover from one size of fabric plies to another.

In joining the two fabric plies, for example a pair of pants, undesirable shifting between the plies can occur. This shifting may occur either initially after the fabric plies have been aligned but before the start of sewing or during the sewing operation itself. As a result, the ends of the two fabric plies do not match, that is one is longer than the other.

The invention hereunder consideration involves a system which attaches to an appropriate sewing machine having a differential feed system as a part thereof and controls the actuation thereof. Fabric measuring means are employed to measure the fabric as it is being sewn, compare the values or lengths of the top and bottom plies and then cause the necessary actuation or deactuation of the proper differential feed to achieve the necessary alignment. By arranging one measuring means adjacent each fabric ply and measuring the amount of feed thereof it is possible to control the relations of the rate of feed of the two plies.

A second feature involves a measuring cycle which occurs generally prior to the sewing step. As is apparent it is desirable to join the two fabric plies such that the ends thereof match. If however, one ply is longer than the other it becomes necessary to feed and sew the long ply faster than the short to compensate for this excess of material. Thus, initially the two lengths or the lengths of the two fabric plies are measured and compared against a predetermined value. A logic system is then employed in conjunction with, for example, a stepper motor to cause the necessary and proper feed control such that in the finished product the ends of the two plies will match.

It is therefore, an object of this invention to provide a fabric length monitoring and logic system capable of controlling the feeding of two fabric plies. It is yet another object of this invention to provide a fabric length monitoring and logic system which measures two fabric plies prior to the joining thereof and controls the feed of each ply such that the ends thereof match. Another object of this invention is to provide a logic system for controlling the feed rates of two different plies of material which can be programmed to distribute errors in length over the entire length of the shorter piece or distribute such lengths error along given stretches of the shorter ply.

With the above and other objects in view, the nature of the invention will be more clearly understood by reference to the following detailed description and the accompanying drawings.

In the drawings:

FIG. 1 is a schematic representation of a sewing machine with the fabric length monitoring and logic systems attached thereto as viewed from the front;

FIG. 2 is a partial schematic view showing the device for monitoring the length of the fabric plies prior to the beginning of the sewing operation.

Figure 3:
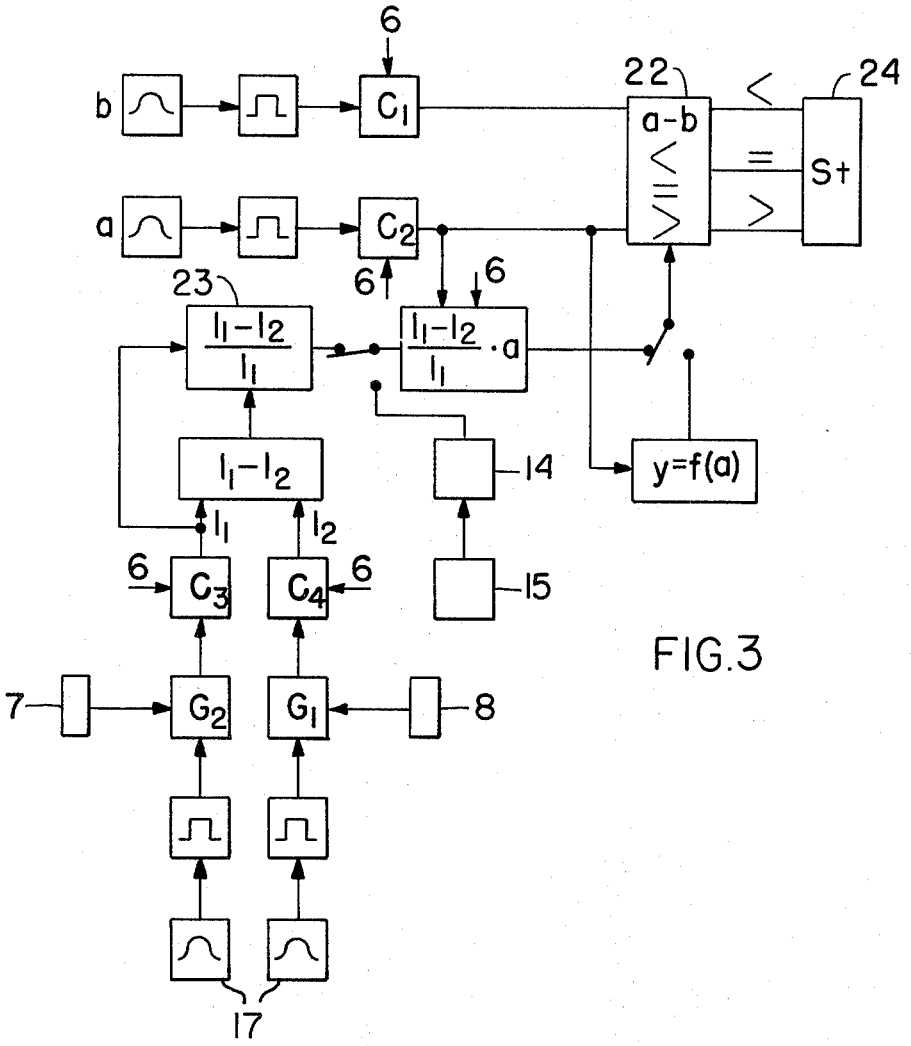
FIG. 3 shows a schematic view of the logic system.

Turning now to the drawings and more particularly to FIG. 1 wherein is shown a sewing machine 1 which is provided with a drive pulley 2 and a differential feed system means 3, as is well-known in the art the differential feed adjustment means 3 can be employed whereby the rates of feed of the differential system can be varied. Adjacent the sewing head of the sewing machine 1 are polar or cog wheel means 4. These wheel means 4 are located such that one and only one wheel contacts each ply of fabric in a manner whereby the wheel measures the amount of material which passes. In the first embodiment of the invention herein described as the fabric plies A and B pass into the sewing machine their effective feed length, or amount which has passed into the machine is measured by the polar wheels. These lengths are effectively translated into pulses such as *a* and *b* which the wheels generate as they pass through a particular arc. The pulses are transmitted via trigger means, to counter means *c*1 and *c*2 as shown in FIG. 3. In a calculator or logic system means 22 the values of *a* and *b* are compared to determine a given value, such as Y. If the amount of material which has been fed is of the same length with regard to both plies, then Y equals zero and no adjustment is necessary. If however, different lengths of material have been fed then Y assumes a variable value which in turn causes the actuation of a stepper motor 24 to cause a change in the feed stroke of the proper differential feed to correct for the value differences between *a* and *b*. Such control or logic systems are well-known to those skilled in the art and can be constructed with a minimum amount of difficulty. Also stepper motors as well as linkage for controlling differential feeds are known in the art. Therefore, no further discussion of these assemblages will be made.

If it is initially realized that the two plies which are being joined are of different lengths, an assemblage as shown mainly in FIGS. 2 and 3 can be employed. This assemblage involves a light source means 11 and first and second photoelectric cell means 7 and 8 mounted on a support means 26 which is in turn carried on a track or other means (not shown) whereby the entire assembly can be moved in a vertical plane with regard to the cloth plate of the sewing machine. The two fabric plies are inserted under the presser foot of the sewing machine or otherwise held and the support system 26 is moved down along the plies toward their ends. The support system has secured thereto in a following relationship a third polar or cog wheel means 28 such as by a wire means 30. Prior to the start of the sewing operation the length of the two fabric plies can be accurately determined by the pulses being generated by the cog wheel 28 due to the downward movement of the system 26. These generated pulses indicated by 17 in FIG. 3 are passed through a similar system as with the embodiment previously discussed. That is, the impulses via triggers pass through a series of gate means to counter means *c*3 and *c*4. The pulses are counted in counter means *c*3 and *c*4, they being in turn controlled by the two gate means *g*1 and *g*2. These gate means *g*1 and *g*2 are in turn controlled by the photoelectric cell means 8 and 7 via appropriate wiring extending therebetween.

In operation the pulses generated by the cog wheel 28 are counted by the counters *c*3 and *c*4 which in turn give rise to values L-1 and L-2 until one of the plies, because it is shorter, uncovers the light source which is immediately sensed by the photoelectric cell. This in turn causes the blocking of the associated gate thus causing the counting associated with the shorter fabric length to step. The pulse counting, however, continues on the longer ply and as a result determines the amount of extra length of the remaining ply. Thus, the two values L-1 and L-2 are created. In the logic system 23, L-2 is subtracted from L-1 and the resultant difference is divided by L-1 and multiplied by a factor *a*. The factor Z obtained by this calculation is now compared with the value Y as previously determined. This function is shown in FIG. 4.

Figure 4:
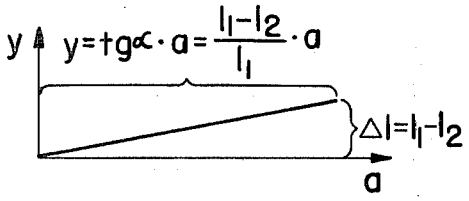
FIGS. 4 and 5 represent functions whereby the length differences can be either distributed uniformly across the shorter ply or just along sections thereof.

According to FIG. 4 the length difference between the two plies is uniformly distributed over the total length of the lower ply (pulses *a*) so that the ends of the plies will match. For example, if the upper ply A is longer than the lower ply B, Z will differ from 0. Assuming that there is no slippage between fabric and feed dogs and provided the measured difference Y is 0, the stepper motor will set the upper feed stroke to the calculated feed increasing value. Now, when the upper feed stroke has thus been corrected, the next calculated difference Y will be equal to Z and no further control of the stepper motor is necessary. In other words, when the stepper motor is set once according to the corrective value no further adjustment is required.

In case there is a length difference e.g. a miscut as described in the foregoing paragraph, and if there is in addition shifting of the two plies due to improper feeding as is also referred i.e. $a-b = Y \neq 0$, then both control versions will work simultaneously resulting in compensation of the improper feeding as well as the difference in length.

Figure 5:
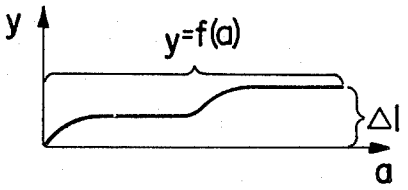

However, if the length difference shall be compensated for at different rates over the total length, as shown in FIG. 5, a preprogrammed unit is used for generating Y. The preprogrammed unit can be controlled by a punched tape coupled to the feed drive mechanism of the sewing machine.

Scanning means 6 resets all counter means C and the logic system means to O as soon as the ends of the plies A and B pass. Such scanning systems are well-known and a man skilled in the art can construct it.

Control system 14 is used when a number of plies to be joined differs in the same and known amount of length. In other words, $$\frac{L1 - L2}{L - 1}$$

is a known figure.

Then the control system 14 is adjusted to this figure and the corrective value *y* is generated by the control device in place of the unit shown in FIG. 2.

Adjustment system 15 is used in connection with the control system 14 to adjust the feed ratio to concentrate the length correction to certain portions of the length e.g. as shown in FIG. 5.

Thus it is apparent that there has been provided, in accordance with the invention, an Automatic Feed Control Device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A Sewing Machine for joining a plurality of fabric plies having a differential feed means, and means for matching the ends of said plies upon completion of a sewing operation, said means comprising:

a first measuring means for continuously measuring the effective feed length of each individual fabric ply and for supplying a first variable value corresponding to the difference in the effective feed lengths of said plies;

a second measuring means for measuring the lengths of said fabric plies prior to sewing, including means for generating a resultant output;

logic means receiving said resultant output from said measuring means, said logic means includes means for producing a second variable value corresponding to the length difference of said fabric plies; and comparator means receiving said first and second variable values, said comparator means comparing said values and supplying a corrective value to said differential feed means when said values differ whereby variances in fabric lengths are corrected over the total length of said plies to bring the ends of said pieces into registration with one another upon completion of said sewing operation.

2. A sewing machine of claim 1 wherein said first means is comprised of:

at least one monitoring means contacting each of said fabric plies continuously measuring the effective feed lengths of said plies as they are fed to said machine and for supplying a signal corresponding to the difference in the effective feed lengths of the two plies; and a calculator means receiving signals from said monitoring means for creating a first variable value means when said signals vary.

3. A Sewing Machine for joining a plurality of fabric plies having a differential feed means, and means for matching the ends of said plies upon completion of a sewing operation, said means comprising:

a preprogrammed unit for producing a first non-variable value;

a measuring means for measuring the lengths of said fabric plies prior to sewing and for producing a resultant output; and logic means receiving said resultant output from said measuring means, said logic means producing a value corresponding to the length difference of said fabric plies; and comparator means receiving said first non-variable value and said logic means value, said comparator means comparing said values and supplying a corrective value to said differential feed means at intervals when said logic means from said non-variable value differs whereby variances in fabric lengths are corrected over predetermined lengths of said plies so that the ends of the plies will match upon completion of said sewing operation.

4. A Sewing Machine of claim 3 wherein said preprogrammed unit can be controlled by a punched tape coupled to the feed drive mechanism of said sewing machine.

* * * * *